United States Patent [19]

Jung et al.

[11] Patent Number: 4,571,104

[45] Date of Patent: Feb. 18, 1986

[54] RETRACTABLE PIN SPROCKET WHEEL ASSEMBLY

[75] Inventors: Werner Jung, Morton Grove; Alfred Z. Purzycki, Arlington Heights, both of Ill.

[73] Assignee: AT&T Teletype Corporation, Skokie, Ill.

[21] Appl. No.: 615,980

[22] Filed: May 31, 1984

[51] Int. Cl.[4] ..... B41J 11/27

[52] U.S. Cl. ..... 400/616.3; 226/76

[58] Field of Search ..... 400/616, 616.3; 226/74, 226/76, 82, 83, 89

[56] References Cited

U.S. PATENT DOCUMENTS

| | | | |
|---|---|---|---|
| 2,000,649 | 5/1935 | Sherman | 197/133 |
| 2,112,833 | 4/1938 | Dybvig | 400/616.3 |
| 2,414,478 | 1/1947 | Metzner | 226/76 |
| 2,683,519 | 7/1954 | Davidson | 226/81 |
| 2,815,672 | 12/1957 | Storer | 226/81 |
| 4,033,493 | 7/1977 | Levinson | 226/87 |
| 4,133,613 | 6/1979 | Webster | 400/616.3 |
| 4,469,263 | 9/1984 | Seitz | 226/74 |

FOREIGN PATENT DOCUMENTS

| | | | |
|---|---|---|---|
| 89630 | 3/1928 | Austria | 400/616.3 |
| 555817 | 9/1943 | United Kingdom | 400/616.3 |

*Primary Examiner*—Clyde I. Coughenour
*Attorney, Agent, or Firm*—A. A. Tirva

[57] ABSTRACT

A platen assembly, including a cylindrical platen, for advancing a web of record material through a printing device, the record material having perforations along its borders for receiving pins disposed in pin sprocket wheel assemblies mounted on opposite ends of the platen.

3 Claims, 6 Drawing Figures

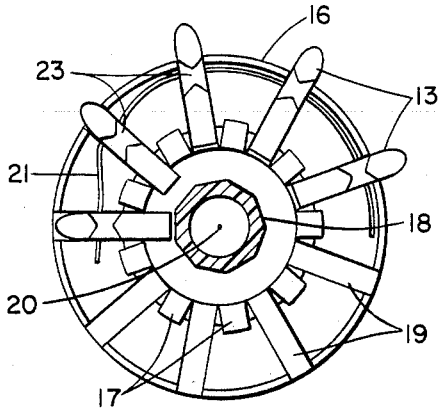
FIG. 4
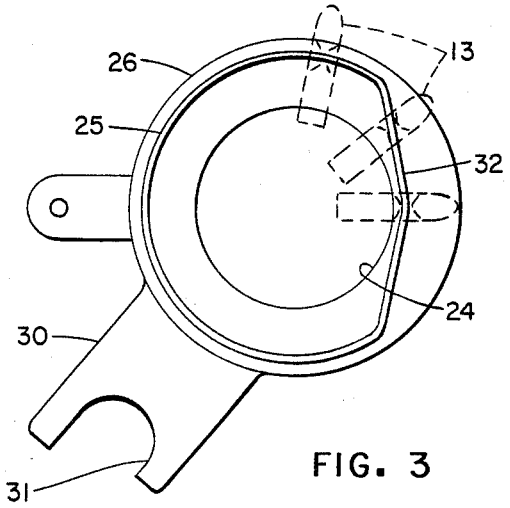
FIG. 3
FIG. 6
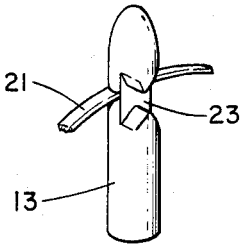
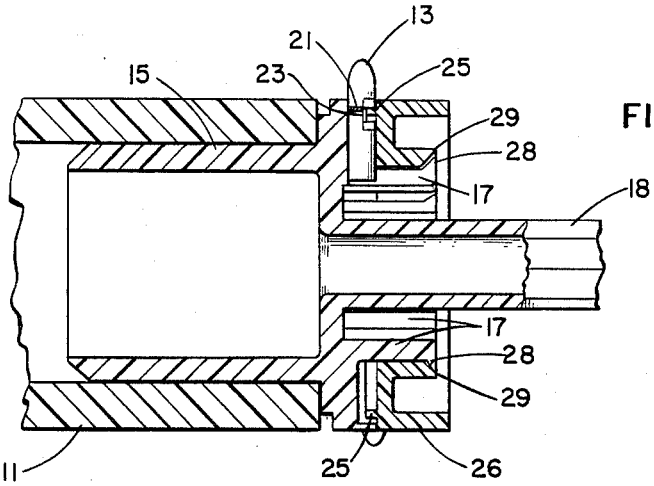
FIG. 5

RETRACTABLE PIN SPROCKET WHEEL ASSEMBLY

DESCRIPTION

1. Technical Field

This invention relates to printers for recording information on sheet material and more particularly to printer platens for advancing the sheets with retractable pin sprocket wheels past a printing position.

2. Background Art

Cylindrical printer platens are widely used in such applications as teleprinters, typewriters, etc. It is well known that positive advancement and accurate alignment of the sheet material can be realized by providing these platens with circumferentially disposed sheet alignment pins. These alignment pins are particularly useful in applications requiring close registry of multiply sheets or where preprinted forms must be precisely positioned during the printing operation.

Since these alignment pins extend beyond the outer surface of the platen, they tend to interfere with the operation of the printhead for the first and the last portions of its motion across the platen. This in turn limits the width of the area of the paper upon which information may be recorded. More efficient use may be made of the full width of the paper if the pins are deleted; however, the advantages inherent in the use of the pins are then lost.

A number of commercially available printers solve this problem by providing platens in which the circumferentially disposed pins are retracted for a predetermined period of time to eliminate the interference between the printing head and the pins. Typical arrangements are shown in U.S. Pat. Nos. 2,000,649 and 4,133,613. While these commercially available printing platens with retractable pins perform well, the manufacturing of the pins and integration of the pins into the platen assembly so that they cooperate with the movement of the platen is expensive, because it necessitates the handling of each individual pin during the manufacture and assembly process of the platen assembly.

DISCLOSURE OF THE INVENTION

In accordance with the present invention, we provide a platen having two retractable pin sprocket wheel assemblies located at opposite ends of the platen, wherein each retractable pin sprocket wheel assembly incorporates a plurality of pins joined by a thin web of material which holds the pins circumferentially a predetermined distance apart. Each pin has a lateral notch which is engaged by a lateral flange of an eccentric box cam held stationary while the platen and the pins rotate. The pins moving along the cam flange reciprocate radially in and out past the periphery of the platen.

THE DRAWINGS

FIG. 3 is a sectional view of the assembly taken along line 3—3 of FIG. 1.

FIG. 4 is a sectional view of the assembly taken along line 4—4 of FIG. 1.

FIG. 5 is a sectional view of the assembly taken along line 5—5 of FIG. 1.

FIG. 6 is an isometric partial view of an individual pin of the pin assembly shown in FIG. 2.

DETAILED DESCRIPTION

Figure 1:
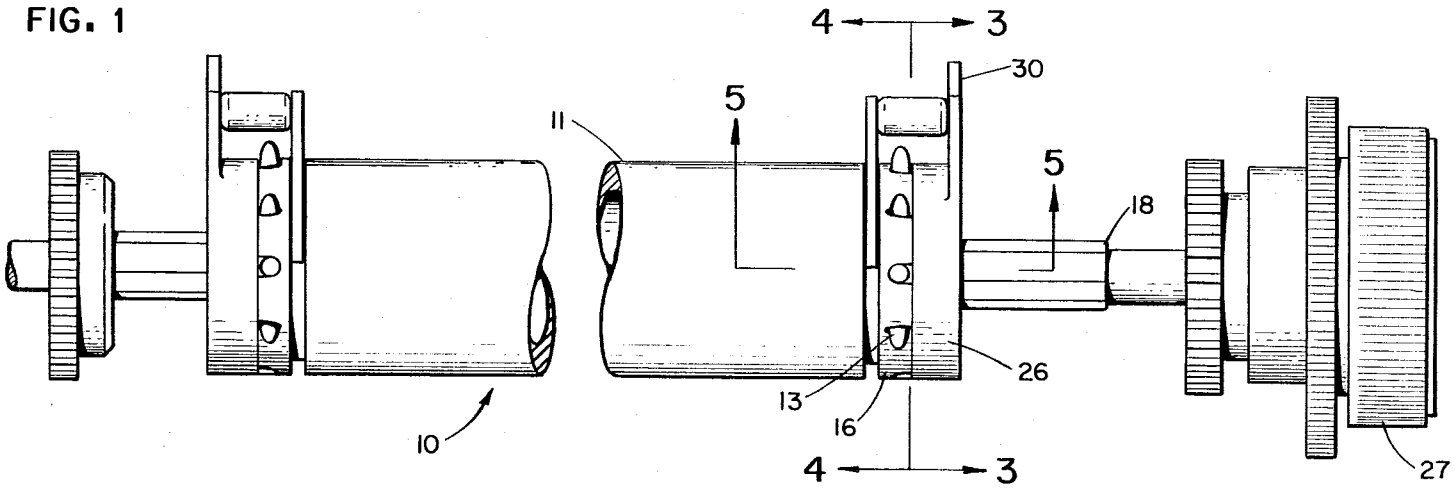
FIG. 1 is a plan view of a printer platen with a pair of retractable pin sprocket wheel assemblies.

Referring to FIG. 1, there is shown a cylindrical platen assembly 10 which mounts in a well-known manner in a printing device such as a matrix printer, a typewriter or the like. The platen assembly 10 incorporates a hollow cylindrical platen 11 and a pair of pin sprocket wheel assemblies 12 mounted on opposite ends of the platen 11. Each wheel assembly 12 has a plurality of pins 13 circumferentially spaced around its periphery. The pins 13 have tapered ends which engage perforations along the edges of a sheet of material (not shown) to provide positive feed of the sheet past a printing station of a printer (not shown).

Figure 2:
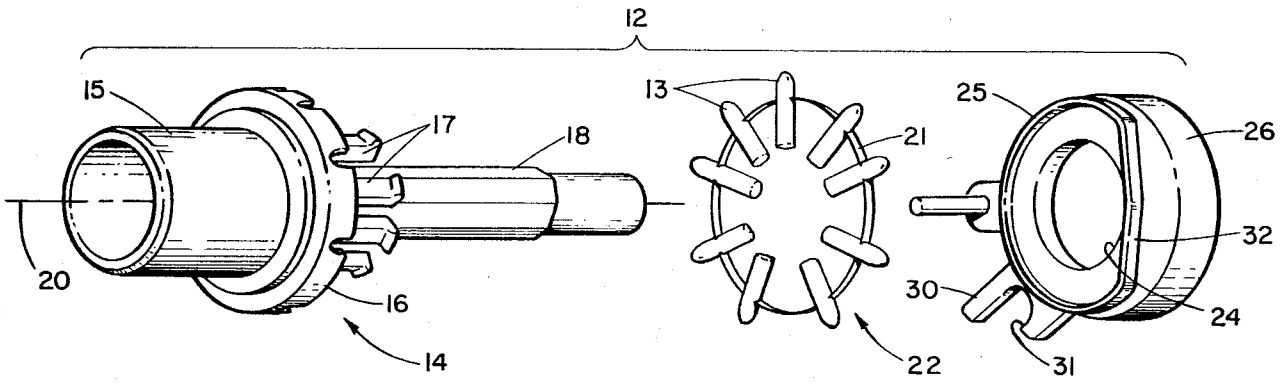
FIG. 2 is an exploded isometric view of a retractable sprocket wheel assembly.

A detailed view of one sprocket wheel assembly 12 is shown in FIG. 2. The wheel assembly 12 comprises a main body 14, a pin assembly 22, and a box cam 26. The main body 14 includes a hub 15, a rim 16, a plurality of flexible fingers 17, and a stem portion 18 all concentric with the hub 15. The hub 15 has an outside diameter which is larger than the inside diameter of the hollow opening in the platen 11 ensuring a positive interference fit between the hub 15 and the platen 11 when the hub 15 is inserted into one of the hollow ends of the platen 11.

The rim 16 has an outside diameter of the same magnitude as the platen 11 and has nine notches 19 emanating radially from the longitudinal center line 20 of the main body 14. Each notch 19 is located between two adjacent flexible fingers 17 and is sized to slidably accommodate a pin 13. The flexible fingers 17 extend from the rim 16 parallel to the center line 20 of the main portion 14 and are located circumferentially around the stem portion 18. The free end of the stem portion 18 is arranged to mount a platen control knob 27.

The pin assembly 22 has nine pins 13 which are molded from a thermal setting type of plastic material. The pins 13 are permanently joined by a thin resilient web 21 molded from the same material and at the same time as the pins 13. Each pin 13 has a lateral notch 23 molded in one of its ends. The resilient web 21 in addition to holding the pins 13 together positions and orients the pins 13 so that they are spaced circumferentially a predetermined distance apart an that the lateral notches 23 all face in the same direction, as shown in FIG. 4.

In the assembly process of the wheel assembly 12, the pin assembly 22 is mated with the main portion 14 by positioning the pin assembly 22 so that each pin 13 is accommodated by a respective notch 19. The pin assembly 22 is oriented so that the lateral notch 23 of each pin 13 faces away from the rim portion 16.

The box cam 26 has an opening 24 and an eccentric flange 25 of a width which is slidably accommodated by the lateral notch 23 of each pin 13. To complete the wheel assembly 12, the box cam 26 is mated with the main body 14 by placing the flexible fingers 17 inside the opening 24 with the flange 25 facing the lateral notches 23. The cam 26 is then slowly rotated while pressure is applied to force the flange 25 into contact with the lateral notches 23 of each of the pins 13. Once the flange 25 mates with the lateral notch 23 of every pin 13, the cam 26 will abut against the rim 16 and tabs 28 located at free ends of the flexible fingers 17 will engage a recessed portion 29 of the cam 26 locking the cam 26 to the main portion 14 but still allowing relative rotary motion between the cam 26 and the main portion 14.

The wheel assemblies 12 are mated with the platen 11 by inserting the hub 15 of each wheel assembly 12 into the opposite hollow ends of the platen 11. The assemblies 12 are held in place via an interference fit between the hub 15 and the platen 11. The platen 11 is then mounted, as previously pointed out, in a printer and is arranged to be driven in a manner well known in the art. The cam 26 is anchored to the printer frame (not shown), so that it remains stationary with respect to the platen 11. For example, in the present embodiment, cam 26 is shown with a tab 30 which has a notch 31 adapted to engage a cylindrical rod (not shown) affixed to the printer frame. While this prevents cam 26 from rotating, the main portion 14 of the wheel assembly 12 including the hub 15, the pin assembly 22 and the rim 16 are free to rotate with the platen 11. As shown in FIG. 3 the cam 26 is locked in place to position the eccentric or flat portion 32 of the flange 25 so that each pin 13 (shown by dotted lines) moving past the printing position of the platen 11 will be below the outer peripheral surface of the platen 11.

A printer platen 11 has thus been described in which pins 13 circumferentially arranged at each end of the platen 11 are retracted below the outer surface of the platen 11 during the portion of rotation of the platen 11 when their extension past the outer surface of the platen 11 would interfere with the operation of the printing head.

What is claimed is:

1. A cylindrical platen having a cylindrical opening at each end;

a pair of pin sprocket wheel assemblies located at opposite ends of the platen;

each wheel assembly comprising a main body including a hub adapted to fit into one of the openings of the platen, the dimensions of the hub and the opening being such as to effect an interference fit between the two;

a rim, concentric with the hub, having an outside diameter substantially equal to the diameter of the platen, the rim having a plurality of notches emanating radially from the center of the rim toward its periphery;

a plurality of flexible fingers extending in a direction normal to the direction of the notches, each of the fingers located between two adjacent notches and along a circumference concentric with the rim;

a readily replaceable unitary pin assembly comprising a plurality of circumferentially spaced radially extending pins interconnected by a flexible molded ring integrally formed with said pins;

a uniform width cam having a cylindrical opening of a diameter sufficiently large to accommodate the plurality of flexible fingers while permitting relative motion between the cam and the rim;

means for rotatably locking the cam to the rim; and means associated with the cam for sequentially moving the pins in and out past the periphery of the rim.

2. A cylindrical platen having a cylindrical opening at each end;

a pair of pin sprocket wheel assemblies located at opposite ends of the platen;

each wheel assembly comprising a main body including a hub adapted to fit into one of the openings of the platen, the dimensions of the hub and the opening being such as to effect an interference fit between the two;

a rim, concentric with the hub, having an outside diameter substantially equal to the diameter of the platen, the rim having a plurality of notches emanating radially from the center of the rim toward its periphery;

a plurality of flexible fingers extending in a direction normal to the direction of the notches, each of the fingers located between two adjacent notches and along a circumference concentric with the rim;

a plurality of pins, each having a lateral notch, the pins joined together by a flexible ring integrally formed with said pins holding the pins circumferentially a predetermined distance apart and orienting the pins so that the lateral notch of each pin faces in a common direction, each pin being of a size and shape to be slidably accommodated by a respective notch in the rim;

a cam of uniform width having a cylindrical opening of a diameter sufficiently large to accommodate the plurality of flexible fingers while permitting relative motion between the cam and the rim;

an eccentric flange of a thickness such that it is slidably accommodated by a lateral slot of each of the pins extending from the cam;

means for rotatably locking the cam to the rim; and means for moving the pins in and out past the periphery of the rim.

3. Apparatus in accordance with Claim 2 wherein the means for rotatably locking the cam to the rim includes the cam having a recess within the cylindrical opening which recess is engaged by tabs located on each free end of the flexible fingers.

* * * * *